US005771601A

United States Patent [19]

Veal et al.

[11] Patent Number: 5,771,601

[45] Date of Patent: Jun. 30, 1998

[54] PROCESS FOR THE DEWATERING OF COAL AND MINERAL SLURRIES

[75] Inventors: Christopher John Veal, Turramurra; Stuart K. Nicol, Charlestown; Barry Kenneth Johnston, Kieraville, all of Australia

[73] Assignee: Commonwealth Scientific and Industrial Research Organisation, Campbell, Australia

[21] Appl. No.: 651,669

[22] Filed: May 21, 1996

[30] Foreign Application Priority Data

May 23, 1995 [AU] Australia ..... PN3140

[51] Int. Cl.[6] ..... F26B 5/08

[52] U.S. Cl. ..... 34/314; 34/320; 34/326; 210/360.1; 210/787

[58] Field of Search ..... 34/312, 314, 320, 34/326, 328, 363, 370, 371, 58, 138, 164, 197; 210/360.1, 372, 374, 377, 380.1, 384, 388, 393, 787, 53; 494/58

[56] References Cited

U.S. PATENT DOCUMENTS

| | | | |
|---|---|---|---|
| 4,000,074 | 12/1976 | Evans | 210/369 |
| 4,101,263 | 7/1978 | Lumpkin, Jr. | 34/363 X |
| 4,130,945 | 12/1978 | Brachthäuser | 34/38 X |
| 4,565,015 | 1/1986 | Hundley, III | 34/58 X |
| 4,594,793 | 6/1986 | Carlson | 34/369 |
| 4,961,722 | 10/1990 | Taylor et al. | 210/374 X |
| 5,561,916 | 10/1996 | Willgohs | 34/363 |
| 5,604,994 | 2/1997 | Annen et al. | 34/314 |

*Primary Examiner*—Henry A. Bennett
*Assistant Examiner*—Steve Gravini
*Attorney, Agent, or Firm*—Ladas & Parry

[57] ABSTRACT

Coal or other mineral slurry is dewatered by establishing a bed of the slurry and injecting a gas stream such as air into the bed to establish turbulent flow to strip moisture. This slurry may use particles in the range 0.5 mm to 30 mm with air injected at about 10 m/sec, and suitable novel apparatus includes a centrifuge or a vibratory conveyor with a closed tunnel and transverse air flow for stripping moisture.

10 Claims, 11 Drawing Sheets

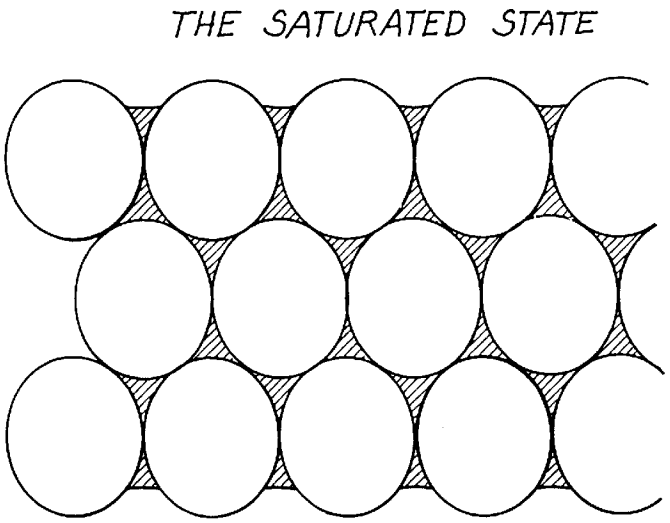
FIG. 9A
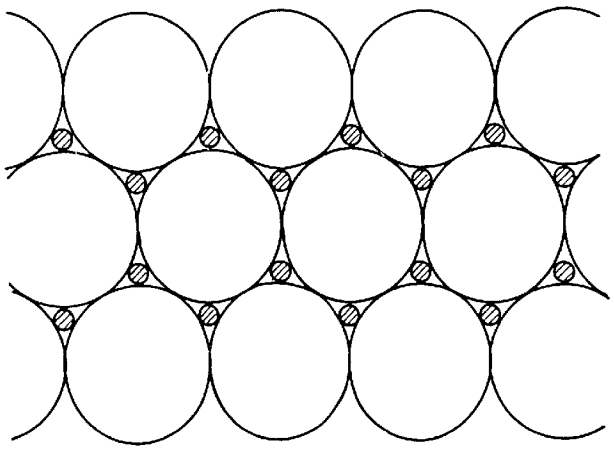
FIG. 9B
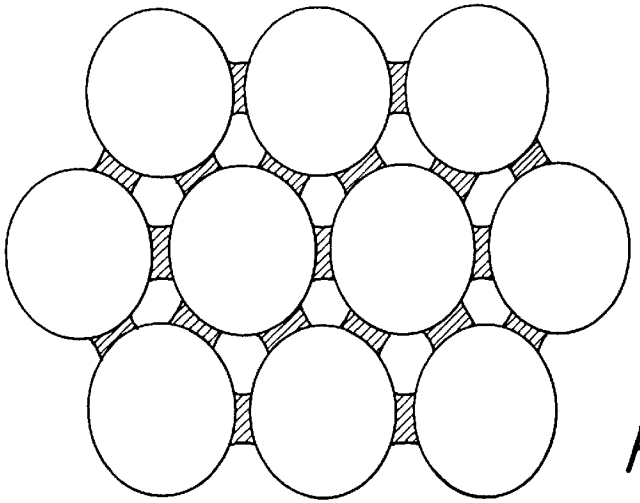
FIG. 9C
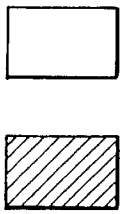

PROCESS FOR THE DEWATERING OF COAL AND MINERAL SLURRIES

FIELD OF THE INVENTION

The present invention relates to an apparatus and method for reducing moisture content of a particulate mass such as ground mineral material e.g. coal. Typically minerals and especially coal products contain a substantial percentage by weight of water and accounting for as much as 10% of the mass. In this specification, particular attention will be given to the treatment of coal, but it is to be understood that apparatus embodying the invention and the methods of the invention may also be applicable to other similar mineral masses which in their initial state are described as slurries.

BACKGROUND TO THE INVENTION

Conventional processes for moisture removal from minerals such as coal include screening, centrifugation and vacuum filtration. In the case of coal products, it is economically important to reduce the moisture content prior to land transport of the particulate mass as transport costs are essentially according to weight and it is an economic penalty to transport as much as 10% of the weight of the product as unwanted water. Furthermore, in some industrial processes using coal products, such as power generation, it is a substantial thermal penalty to have a significant level of moisture in the coal as energy in burning the coal is then utilised in driving off the moisture as steam.

For many years, it has been conventional to use centrifuges to reduce moisture levels to around 6 to 8 wt % where the particle size range is typically less than 30 mm and greater than 0.5 mm. With conventional practice, a practical limit for dewatering is controlled by the relative opposing magnitudes of capillary forces causing the water to be retained in the particulate mass and the applied forces attempting to strip the water from the mass.

SUMMARY OF THE INVENTION

In a method aspect, broadly the present invention consists in a method of reducing moisture content of a bed of solid particles comprising subjecting the bed to a stream of gas to establish turbulent flow through the bed to strip a significant proportion of the moisture contained in the bed.

In an apparatus aspect, the present invention consists in an apparatus for processing a bed of solid particles containing moisture, the apparatus comprising a processing zone for receiving the bed, means for admitting and injecting into the bed a gas stream so as to establish a turbulent flow through the bed and to strip moisture, discharge means being provided for discharging the gas with entrained moisture.

A most important embodiment of the invention is one in which processing of the bed takes place in a centrifuge which for a practical commercial embodiment would be a continuously operating centrifuge. However other embodiments are possible such as advancing the particulate solids in the form of a bed which is moved along a vibratory conveyor such as downwardly inclined tunnel containing a processing zone in which the gas is injected to strip moisture.

It is believed the present invention can successfully reduce the residual moisture in a mineral such as coal and it is considered that a significant advantage can be achieved by reducing the moisture level by 1 wt % of the mass over and above that achievable by known methods such as centrifugation. While not being bound by any particular theory, as can aid to understanding the present invention, the inventors suggest that useful results of the present invention are due to enhanced kinetics resulting from a mass transport mechanism brought about by the superimposition of a turbulent gas flow through the bed.

Preferably, the invention is operated with particles in the range of mainly 0.5 mm to 30 mm although it is acceptable to have a proportion of the particles outside this range. The invention has been found to operate advantageously where 90% of the particles in the mass have a size greater than 1.5 mm and the particle distribution is such that a very low level of fines i.e. less than 0.5 mm are present whereby turbulent gas flow can readily be sustained. It is thought that it is in the turbulent flow which entraps free moisture and removes it.

By contrast, prior published proposals do not include other than using air flow with very fine coal particles and wherein laminar flow conditions were applied.

Preferably the present invention is implemented using a relatively low pressure air flow as the turbulent gas and this is believed to be particularly successful in promoting hydrodynamic drag of liquid from within the inter-particle voids.

The present invention is believed to be particularly applicable to particles having a strong hydrophobic characteristic. It has been found that coal has such a characteristic but other minerals also share this feature. Another application of the invention is one where the method comprises preliminary treatment of particulate matter with a compound to provide a surface effect on the particles whereby a substantial hydrophobic characteristic is established. Then the material can be successfully processed according to principles of the present invention. For convenience and economy, air has been found to be an effective medium for the turbulent gas flow. The air can be at ambient temperature. However other gas flows can be used such as steam and other gases of elevated temperature.

The speed of air flow passing through the particulate mass can be conveniently chosen and in general, it has been found that a speed in the range of 1 to 20 m/sec is beneficial and preferably around 10 m/sec offers a convenient and economic choice.

The invention can be implemented by adaptation of known types of centrifuges of which a vibrating basket type continuous centrifuge is particularly attractive for commercial operations. Preferably a vibrating basket centrifuge is used with a novel air inlet manifold provided to inject air at a multiplicity of locations spaced from and around the axis of the basket. Air can be injected through a manifold having a series of short pipes substantially parallel to the axis of the basket and having apertures for directing air jets radially outwardly.

However, other types of centrifuge could be used such as scroll and screen bowl centrifuges.

Particularly, when a vibrating basket centrifuge is used, operation at a G force in a range 25 G to 120 G is suitable with basket speeds in the range of 200 to 450 rpm.

BRIEF DESCRIPTION OF THE DRAWINGS

Aspects of the invention and experimental reports concerning the invention will now be described with reference to the accompanying drawings of which:

FIG. 9 is a schematic representation of particulate coal containing water;

DETAILED DESCRIPTION OF THE DRAWINGS

Figure 1:
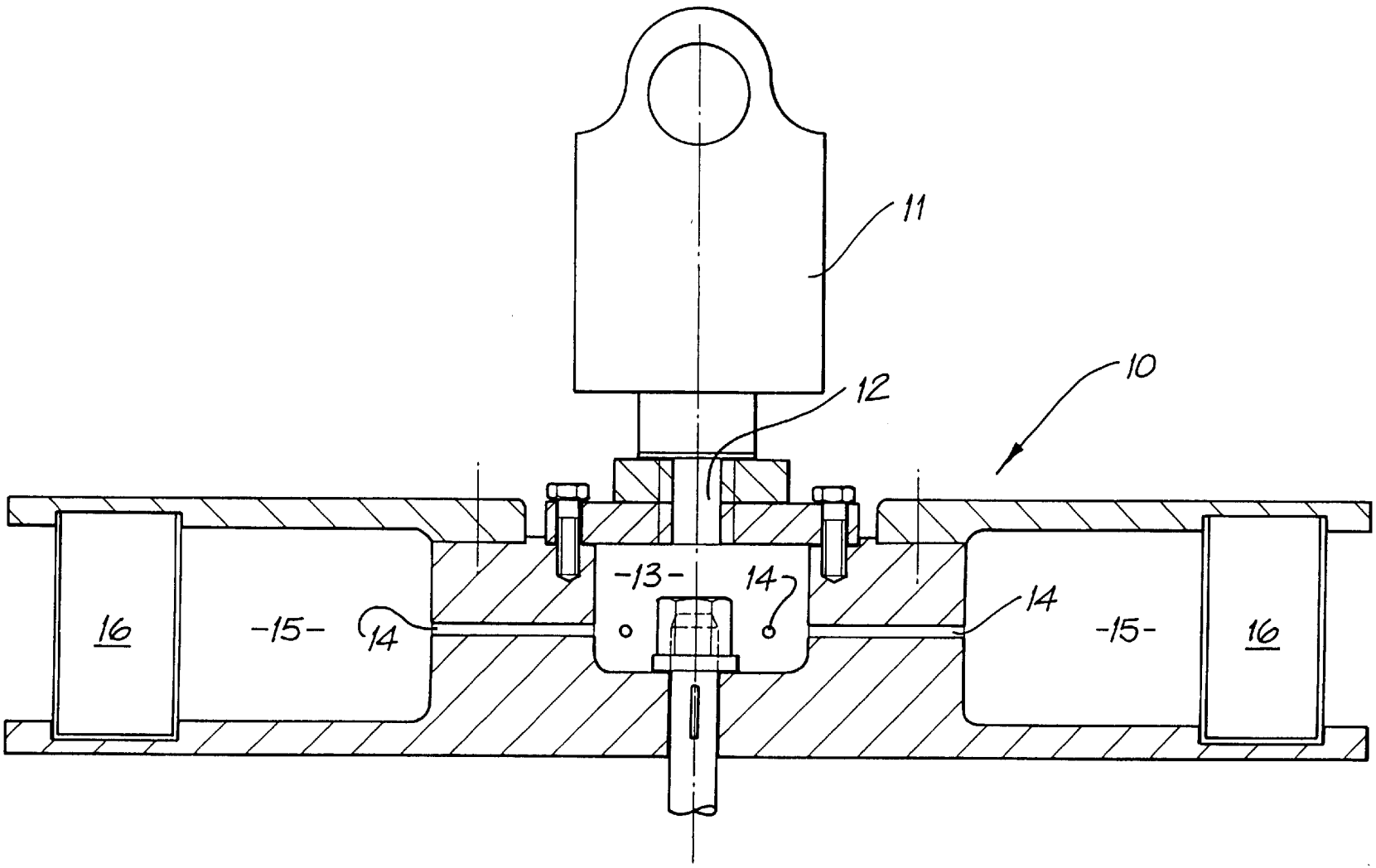
FIG. 1 is a schematic diagram of a laboratory scale centrifuge suitable for batch operations which has been used to demonstrate principles of the present invention.

Referring to FIG. 1, a centrifuge basket 10 is mounted on a rotary bearing 11 drilled through the centre to provide an air inlet 12 leading to a chamber 13 from which radially outwardly bores 14 pass to an outer chamber 15. A batch of particulate coal is located in an annular basket 16.

The illustrated centrifuge is for laboratory scale batch operations and has been used to test out the principles of the invention which will be described further below with reference to data derived from testing. As it was not possible to measure air speed while the centrifuge was spinning, an anemometer was used on the outside of the stationary basket packed with coal before starting centrifuge operations in order to measure air velocity through the coal bed.

Figure 2:
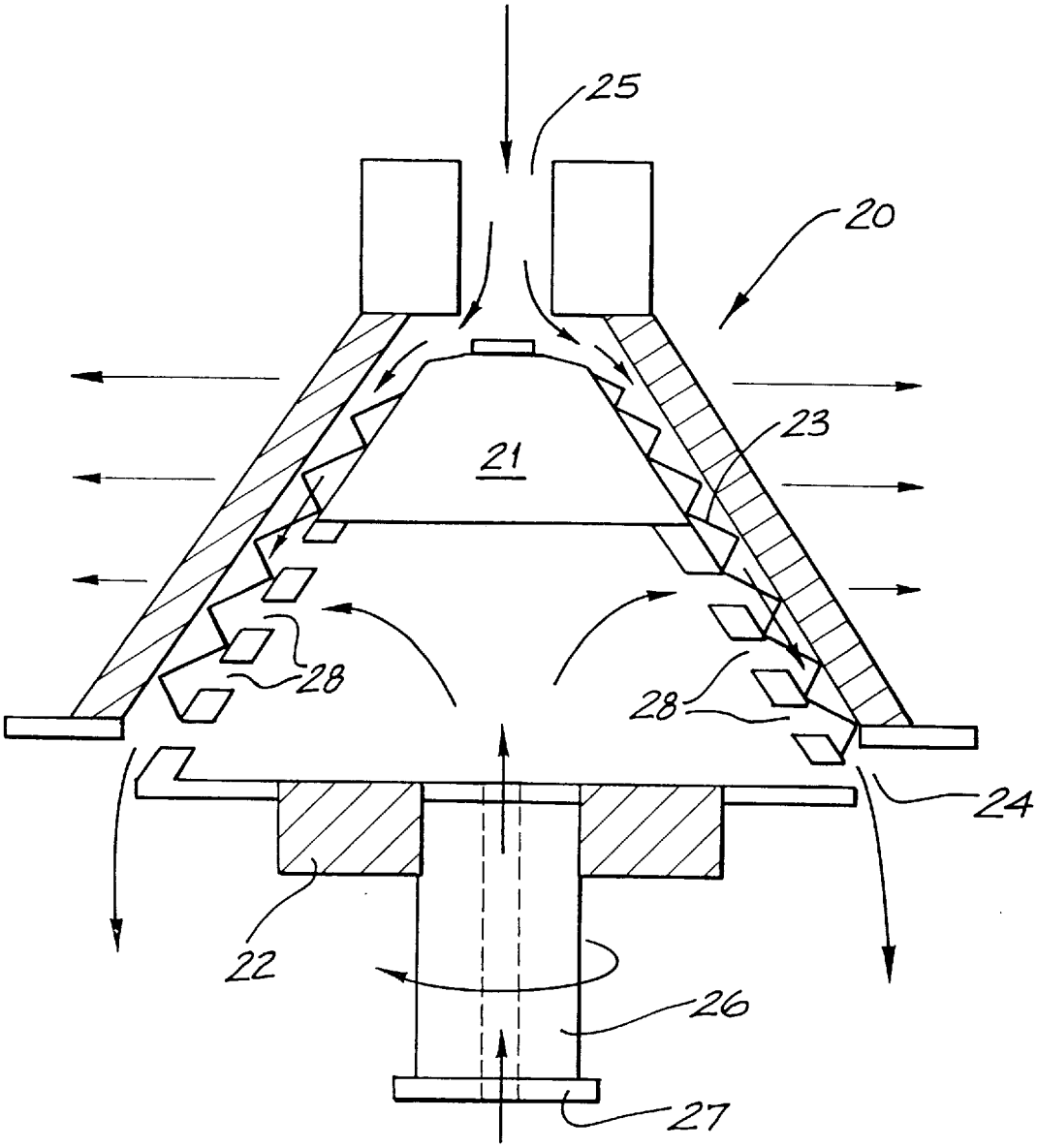
FIG. 2 is a second embodiment shown schematically and being a scroll-type centrifuge having a gas injection system.

Referring now to FIG. 2, a more practical continuous centrifuge is illustrated. This is a scroll centrifuge of known type but modified for the introduction of pressurised gas such as air or steam to implement the concepts of the present invention. In this centrifuge, 20, there is a cone 21 mounted on a rotor 22 and the cone carrying a series of flights 23 down which the coal mass progressively moves to annular discharge location 24. Coal is fed into the centrifuge through an upper axial inlet 25. The rotor is mounted on a hollow drive shaft 26 connected to an air pressure line through an air seal 27 whereby pressurized air is introduced into the cone from which it is radially outwardly discharged through apertures 28 in the cone.

Figure 3:
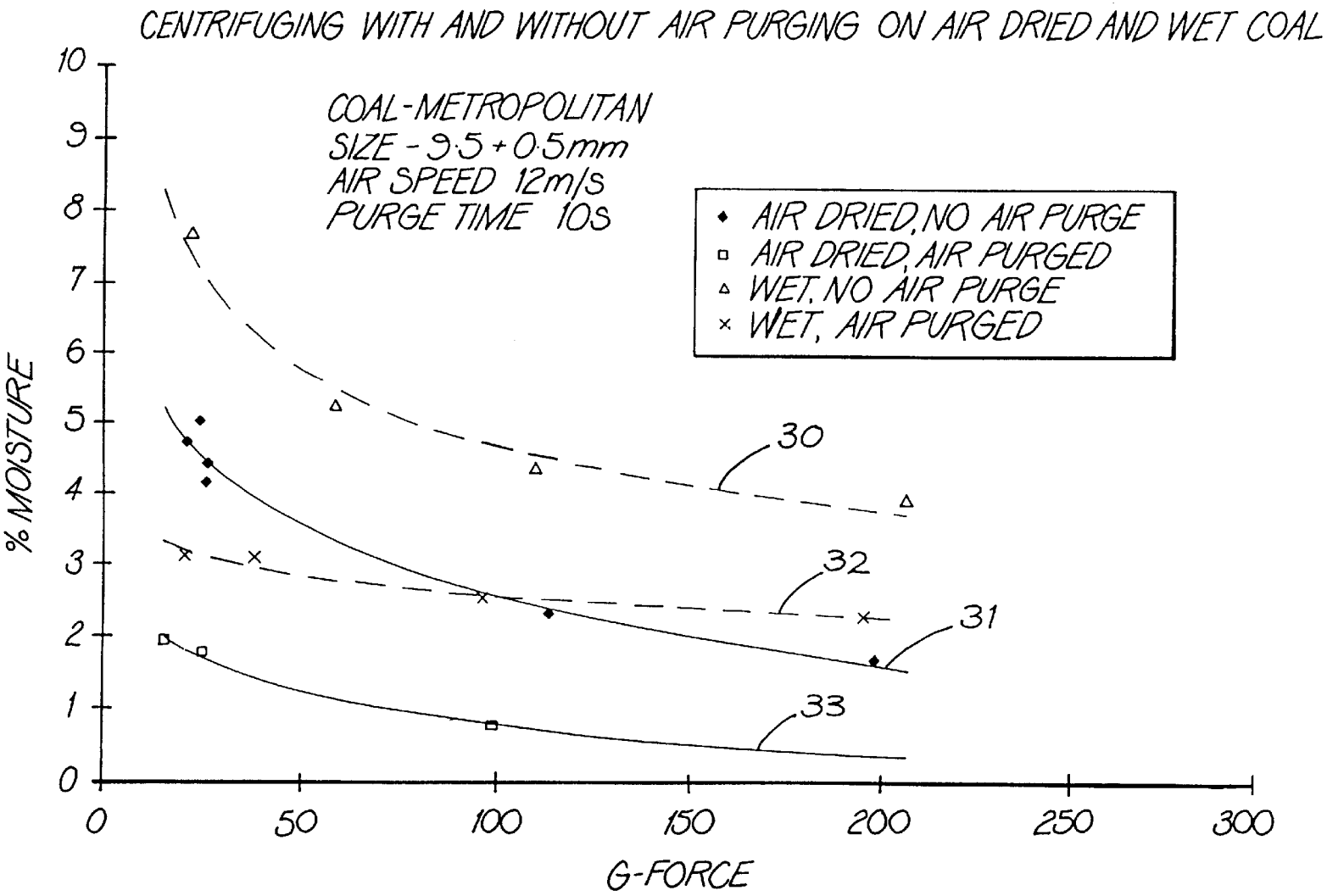
FIG. 3 illustrates the results of testing contrasting centrifuging with and without turbulent air purging.

Referring to FIG. 3, data are presented for coal particles ranging from 0.5 mm to 9.5 mm which were subject to centrifuging. Curve 30 represents wet coal with no air purge, curve 31 represents air dried coal treated without air purge and curves 32 and 33 are for wet coal and air dried respectively with air injected at 10 m/sec for a purge time of 10 seconds during the centrifuge operation in order to strip moisture. Resulting residual moisture level in the coal bed is indicated for different G force values corresponding with different centrifuge basket speeds. The results indicate a substantial improvement in reducing moisture level when contrasting data for use of the air purge with the centrifuging as opposed to centrifuging alone without the air purge.

In each case the initial moisture content was about 10 wt %.

Figure 4:
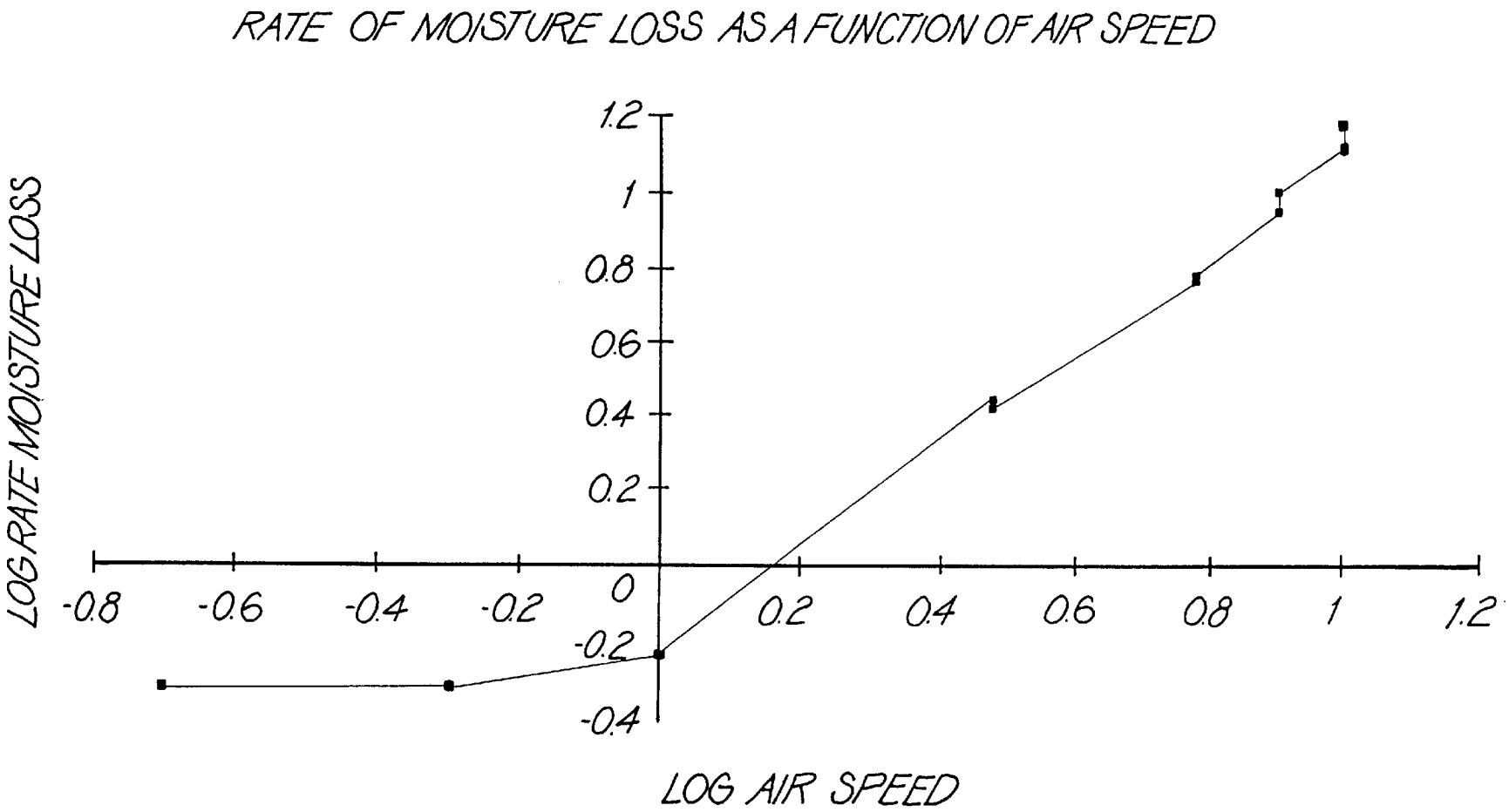
FIG. 4 illustrates rate of moisture loss as a function of air speed.

Referring now to FIG. 4, the plot of the rate of moisture loss with varying air speed shows a marked change in the rate of moisture loss corresponding to gas flow velocities above about 1 m/sec. This indicates a change of mechanism from evaporation at low flow rates to bulk mass transport.

Figure 5:
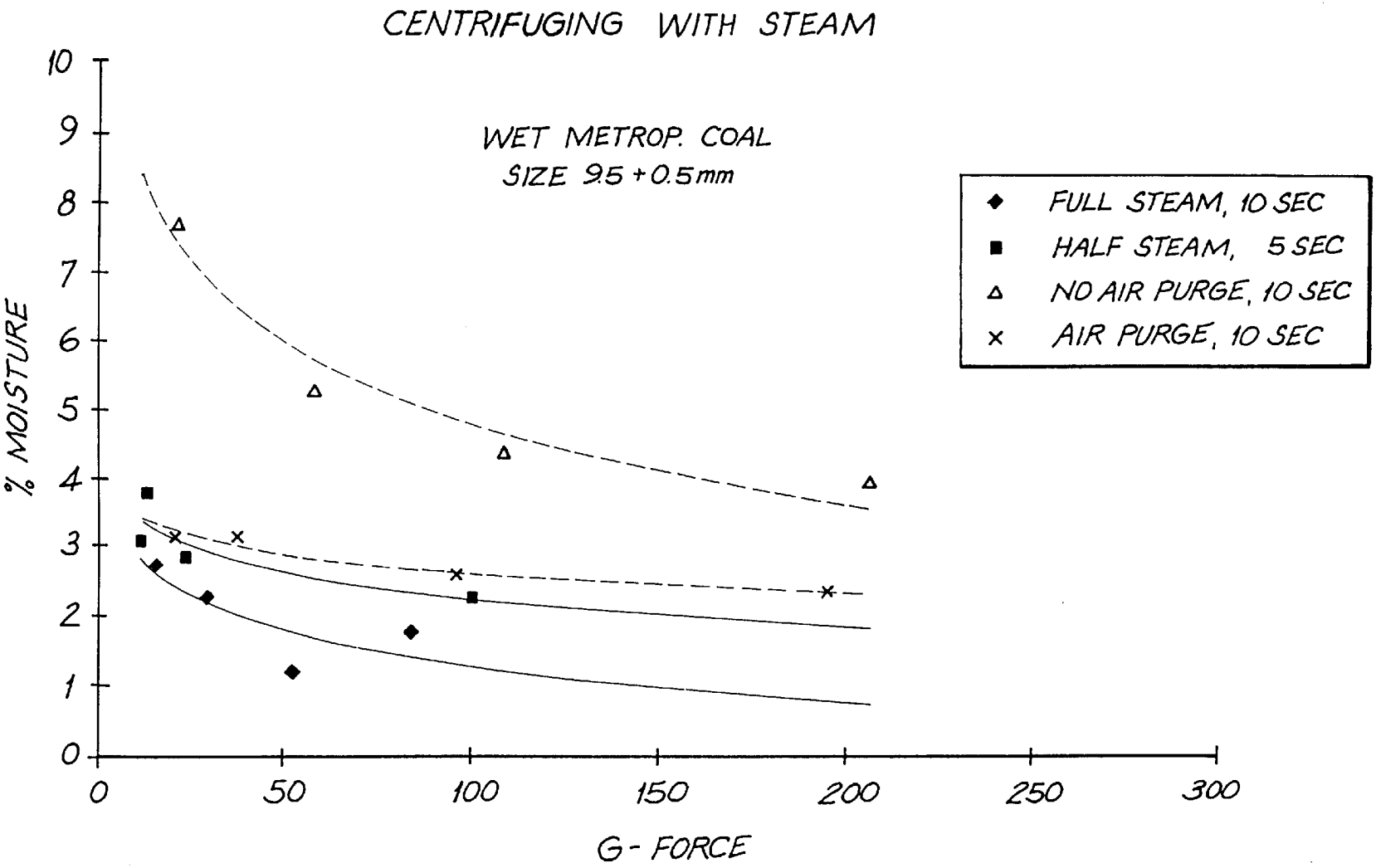
FIG. 5 illustrates the results of centrifuging with steam.

FIG. 5 demonstrates that steam is an alternative to air and significant moisture reduction can be achieved according to this experimental data.

Figure 6:
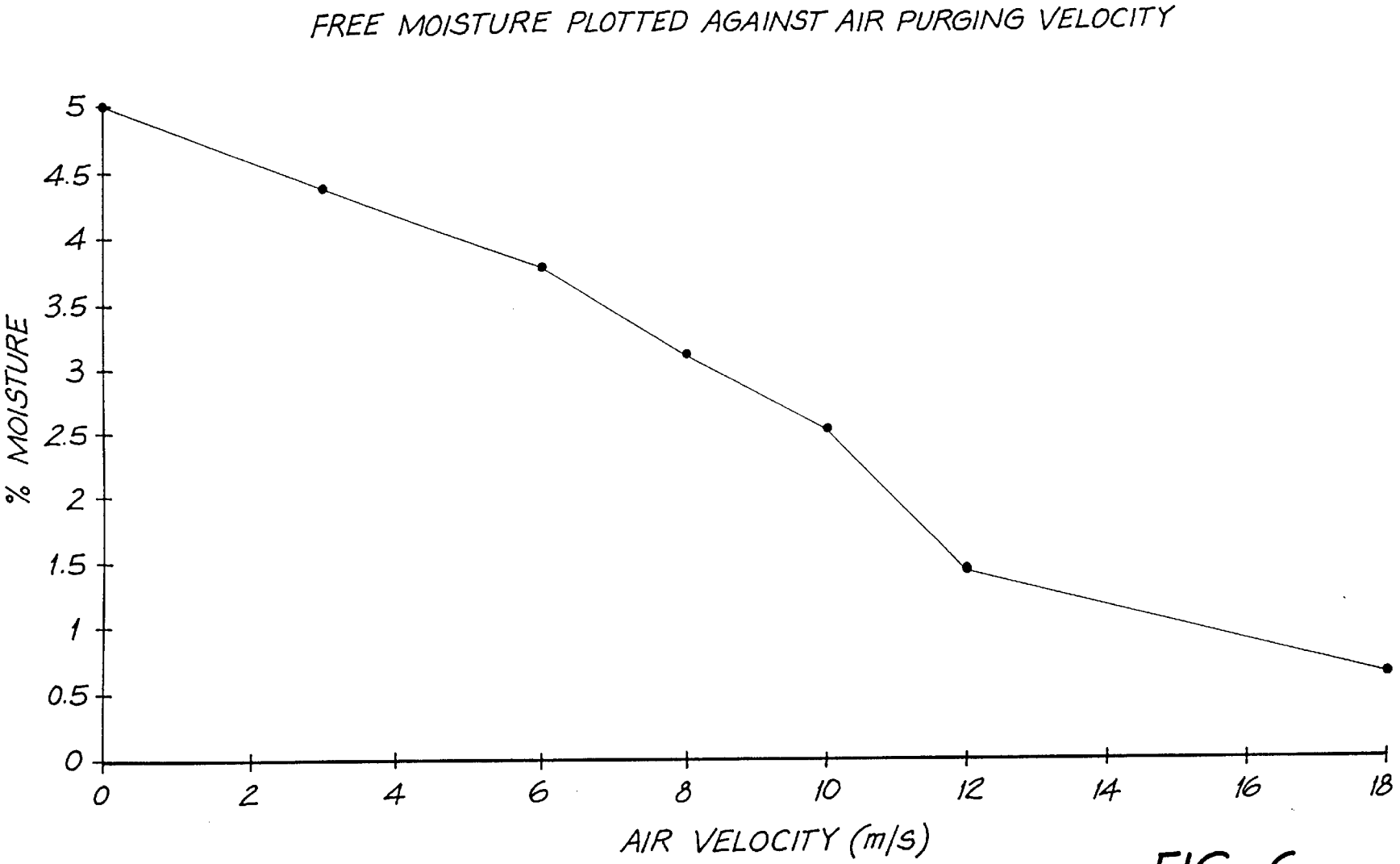
FIG. 6 illustrates the results of tests to demonstrate the effect of air speed on moisture reduction.

FIG. 6 illustrates the data to show a typical profile for moisture reduction plotted against air velocity. Thus it will be seen that with coal particles with a size range typically 1 mm to 10 mm in the main, 12 m/sec is an effective and economically feasible air flow velocity to be utilised.

Figure 7:
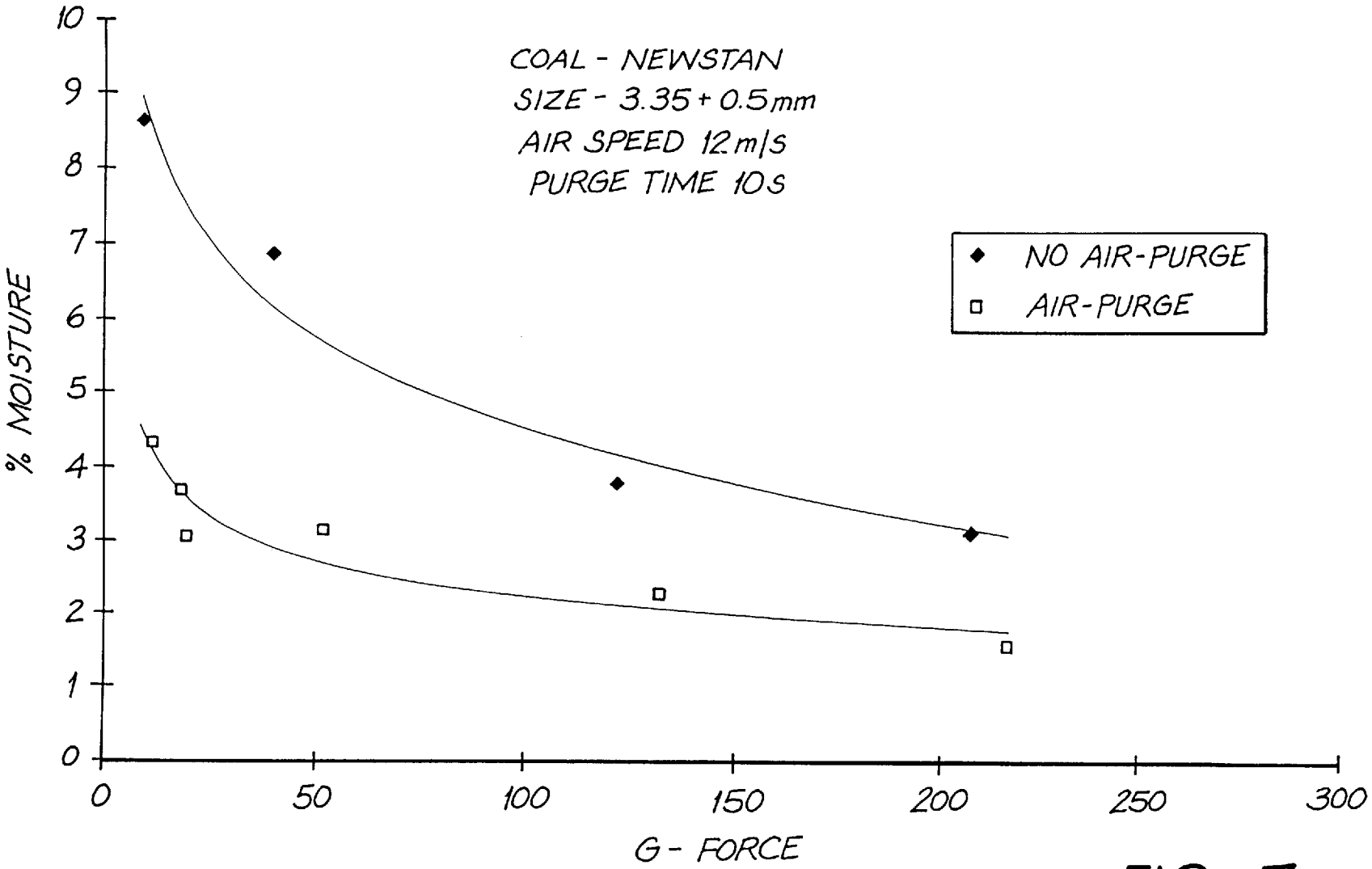
FIG. 7 illustrates centrifuging with and without air purge on fine coal particles.

FIG. 7 illustrates an experiment on fine coal particles in the range below 3.35 mm but greater than 0.5 mm using an air speed of 10 m/sec and purge time of 10 sec. The contrasting data of using an air purge as against merely centrifuging shows a substantial reduction in moisture with, particularly in the case of air purge, only a small improvement when increasing centrifuge speed to correspond with an increase in G force from 50 G to 200 G.

Figure 8:
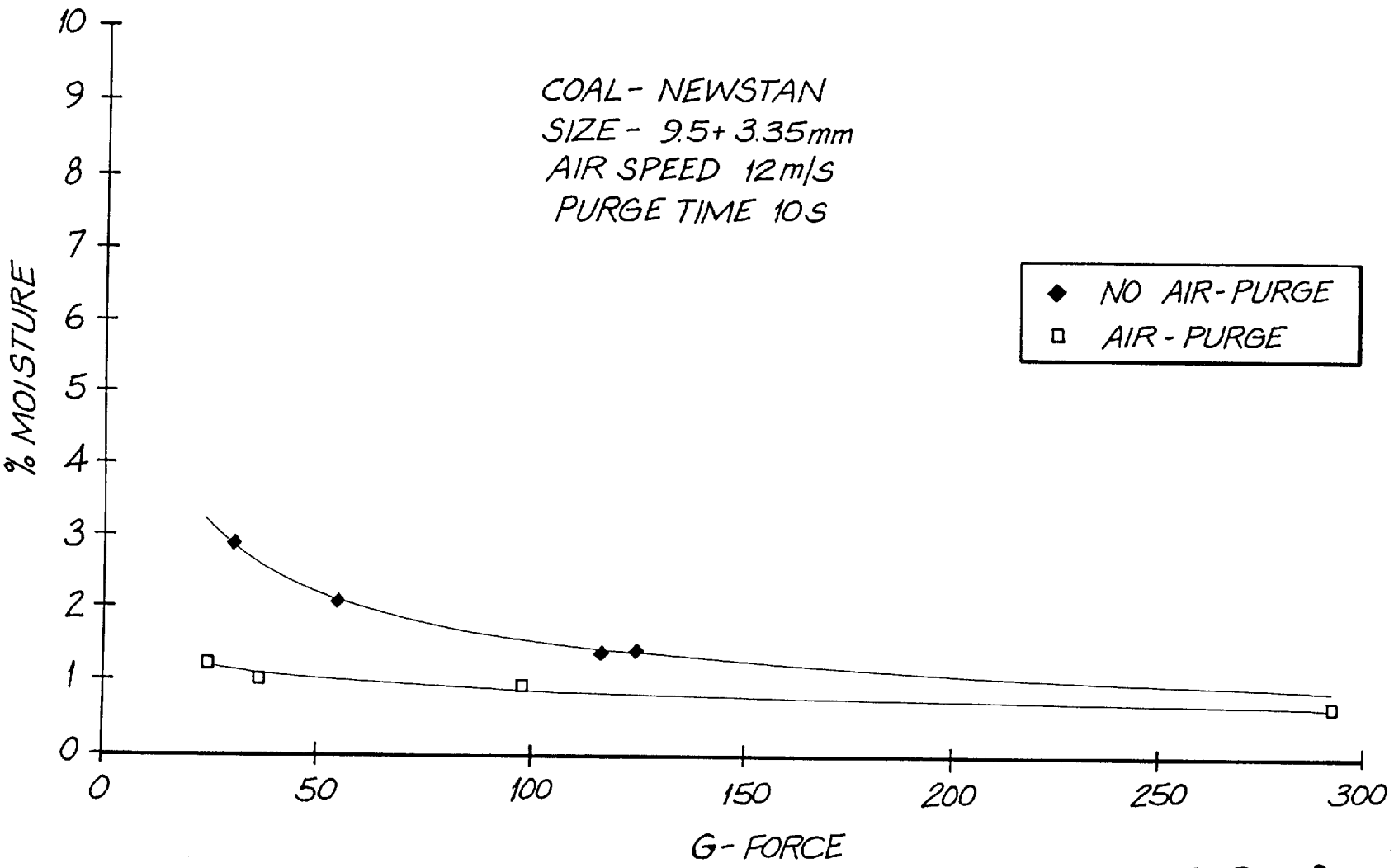
FIG. 8 illustrates centrifuging with and without air purge on coarse coal particles.

FIG. 8 corresponds to FIG. 7 data but uses relatively coarse coal particles in the size range below 9.5 mm and above 3.35 mm.

The above data demonstrates the principles of the invention can be effectively applied to a range of particulate sizes. Reference will now be made to FIG. 9 illustrating various states in which water is thought to be present in a particulate bed of coal particles. In the saturated state (FIG. 9A), water is held under capillary forces to fill the inter-particulate voids. In the pendular state (FIG. 9C), moisture is retained at points of contact between individual coal particles but there is believed to be an intermediate state referred to as the funicular state (9B) in which moisture exists in equilibrium with air dispersed throughout the porous structure. It is suggested that by normal centrifugation of typically coal products (which have not been air dried) there is a limit to the level to which free moisture can be reduced and this is determined primarily by the amount of pendular moisture which, depending on the mode of packing, can be shown theoretically to be around 5 to 7 wt % for a wetting liquid. This figure is in fact consistent with measured values for residual moisture from reported commercial coarse coal centrifuge processes. FIGS. 7 and 8 provide data contrasting fine and coarse coal particle masses but otherwise processed under similar conditions. The residual moisture levels are considerably higher with the fine coal fractions but the moisture reduction achieved by the combination of air purge and centrifugation was considerably greater for the finer fractions at all levels of spin speed. Thus at a speed equivalent to 50 G, a reduction in moisture achieved for fine particles was about 3 wt % compared with about 1 wt % for the coarse particles.

Without being bound to any particular theory the present inventors suggest this data may show two possible phenomena occurring. It is suggested that for the finer coal particles there will be a greater amount of pendular moisture present and which will be available for displacement by the air purge during centrifugation. Secondly the finer the size of the coal particles, the finer will be the size of the inter-particle pores within the bed. This in turn should lead to an increase in turbulence as the air purge occurs and the inventors suggest that this greater turbulence and a thinner boundary layer would make the air purge more effective at removing water. Accordingly, when a complete sized distribution of coal particles is used (say less than 9.5 mm and above 0.5 mm) dewatering characteristics can be achieved more akin to fine coal particles rather than coarse coal particles due to turbulence within pores of the structure. A particulate batch of coal particles mainly in the range of 1 mm to 10 mm is believed to have a greater amount of moisture present in the pendular state.

Figure 10:
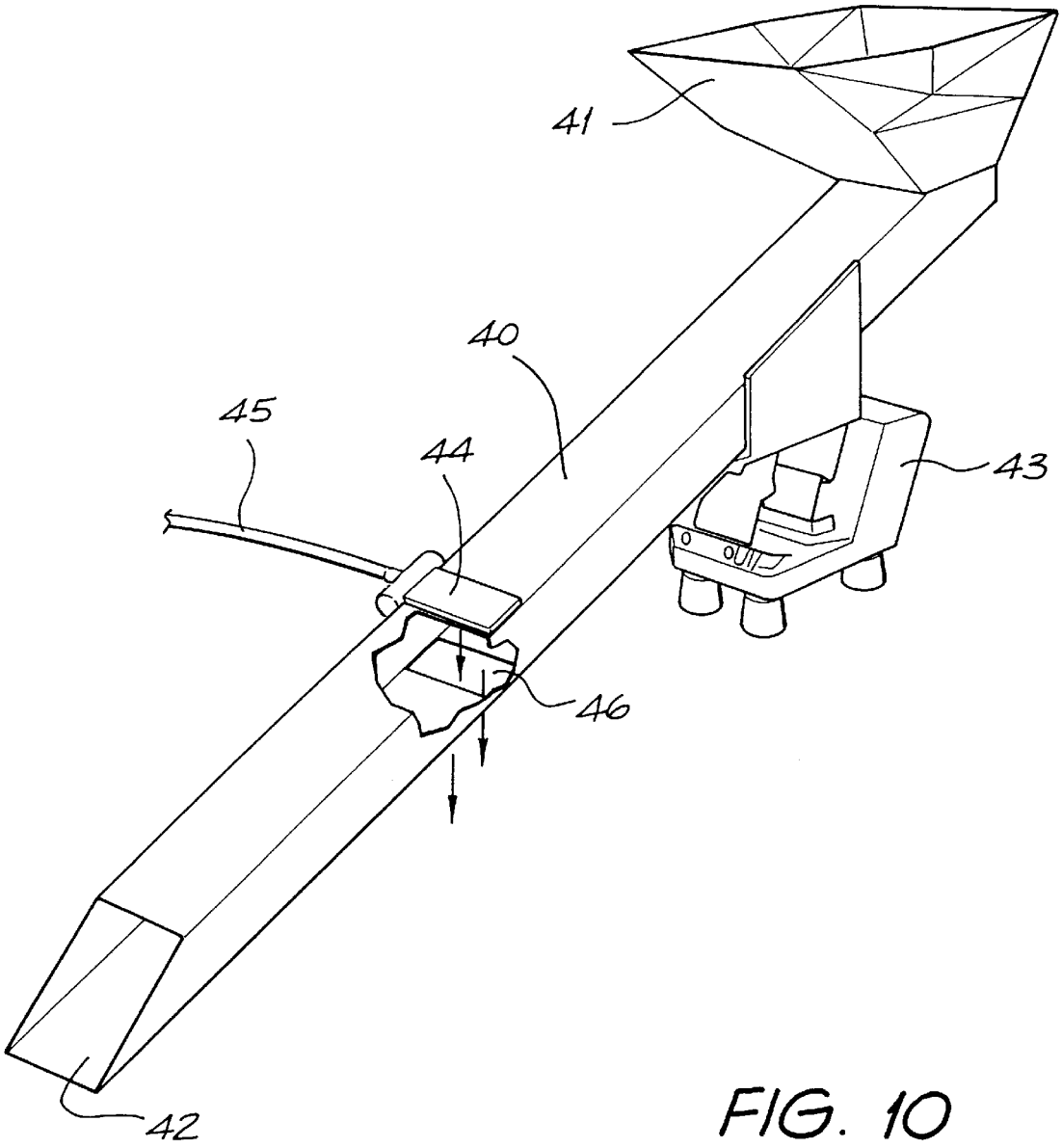
FIG. 10 is a schematic diagram of an embodiment applied to a vibratory conveyor for particulate solids.

Referring now to the embodiment of FIG. 10, which is a vibratory conveyor system, the apparatus comprises a shute 40 having an inlet hopper 41 for receiving particulate coal and a lower discharge port 42, the shute being mounted on a vibratory feeder 43 which causes steady advance of the particulate matter in the form of a bed. In its upper mid-portion, the shute has a manifold 44 connected to a compressed air supply line 45 which discharges a band of air downwardly through the bed for discharge through a suitable grating (not shown in the drawing) covering an air outlet 46. The air is supplied at such flow rate and pressure having regard to the particle sizes in the bed so that turbulent air stream establishes through the bed whereby moisture and in particular moisture in a pendular state is stripped from the bed.

Figure 11:
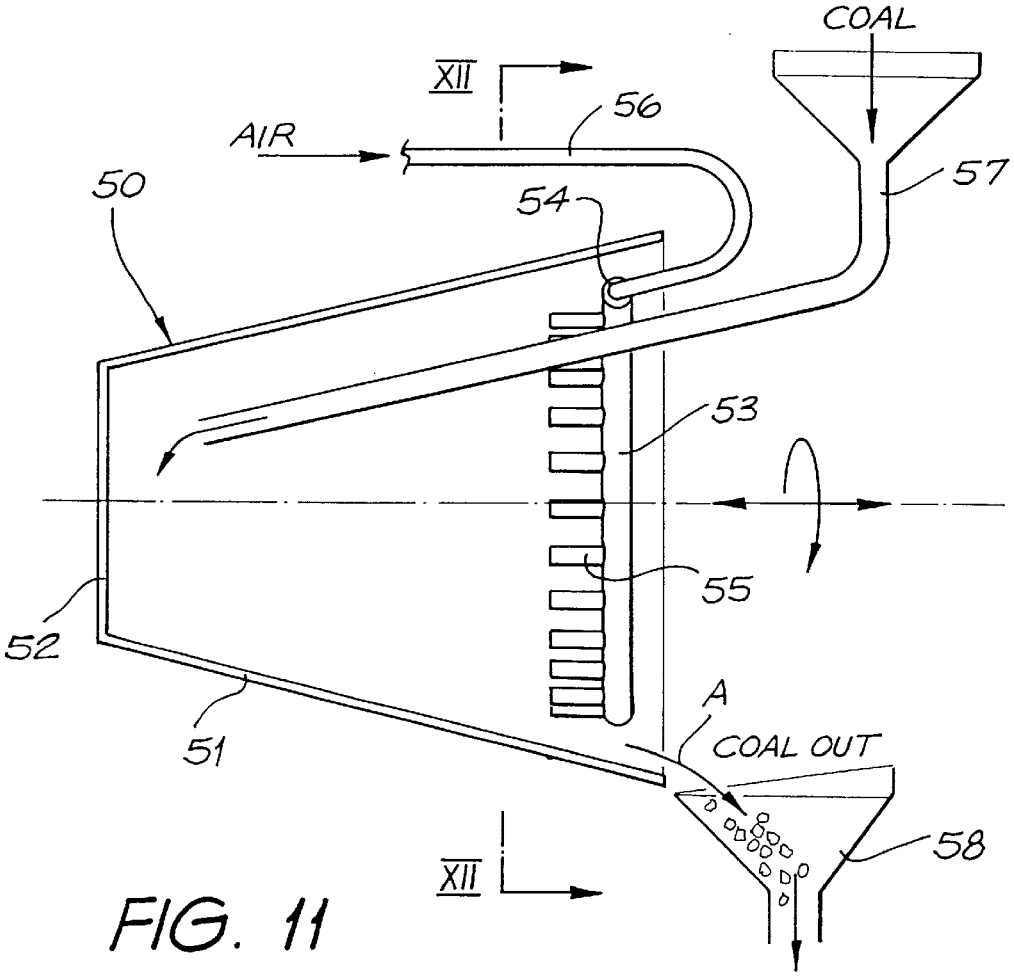
FIG. 11 is a schematic axial cross-sectional view through a vibrating basket centrifuge modified to form an embodiment of the invention.
Figure 12:
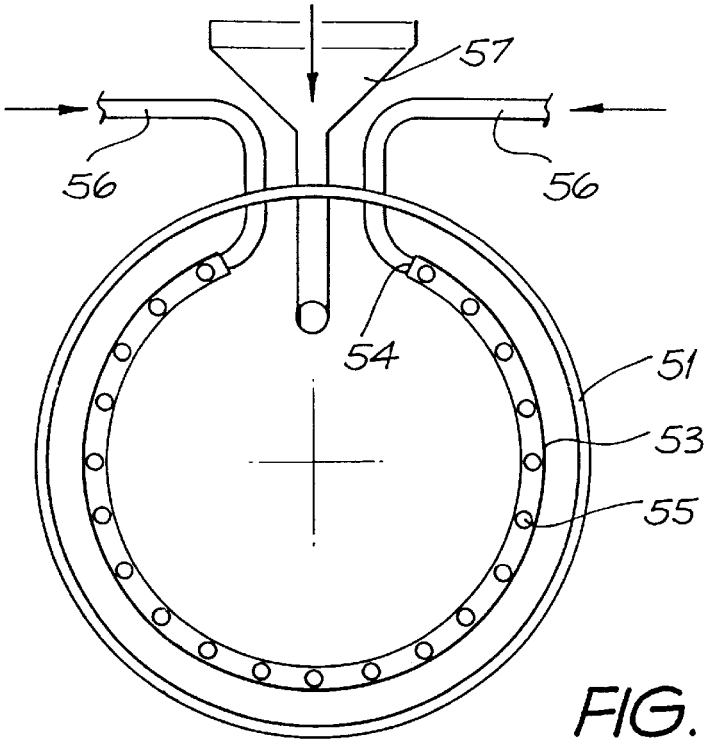
FIG. 12 is a schematic sectional view along the line XII–12.

Referring now to FIGS. 11 and 12, this embodiment has a novel manifold arrangement applied to a vibrating basket centrifuge 50. The centrifuge comprises a frusto-conical basket 51 having an end wall 52 and at its opposite end an air manifold 53 comprising a part circular tube having ports 54 at each (and for the introduction of pressurised air and lateral air discharge tubes 55 each having a series of apertures for directing air jets generally radially outwardly. As shown in FIG. 11 pressurised air is fed through line 56 to each of the ports 54. Particulate coal or other mineral is supplied into the basket through a tubular duct 57 which discharges the particulate coal adjacent the wall 52. The basket is rotated and vibrated horizontally and dried, treated coal particles are discharged at the bottom of the basket as indicated by arrow A into a receiving hopper 58.

In this apparatus the coal particles move under the influence of the vibrations to the wider open end of the basket where discharge takes place. This apparatus is suitable for use in dewatering coal particles with particle sizes in the range of 30 to 0.5 mm.

We claim:

1. A method of reducing moisture content of a bed of solid particles comprising subjecting the bed to a stream of gas to establish turbulent flow through the bed to strip a significant proportion of the moisture contained in the bed, wherein said moisture content of said bed is reduced predominantly by means of a mass transport mechanism effected by the established turbulent flow.

2. A method as claimed in claim 1 and wherein the bed is arranged in a processing zone of a centrifuge.

3. A method as claimed in claim 2, comprising subjecting the bed to said stream of gas in a vibrating basket centrifuge having an air discharge manifold located nearer the open end of the basket and having air discharge nozzles extending into the basket.

4. A method as claimed in claim 3 and comprising using an air discharge manifold wherein the nozzles are provided spaced along tubes which are disposed parallel to the axis of the centrifuge and the nozzles directing airflow radially outwardly.

5. A method as claimed in claim 2 and comprising using a scroll centrifuge providing a pressurised gas stream which is discharged through apertures in a conical inner wall of the centrifuge.

6. A method as claimed in claim 2, comprising subjecting the bed in said centrifuge to a centrifugal force of about 60 G.

7. A method as claimed in claim 1 and wherein the bed of solid particles is continuously advanced along a path and the path is intersected with the stream of air which is discharged together with moisture removed from the bed.

8. A method as claimed in claim 1, and including selecting the bed of particles to be principally sized in the range 0.5 mm to 30 mm.

9. A method as claimed in claim 1, and including selecting the bed of solid particles with at least 90% of the particles sized greater than 1.5 mm and less than 30 mm.

10. A method as claimed in claim 1, comprising injecting into the bed, said stream of gas at a speed of about 10 m/sec, wherein said stream of gas is air.

* * * * *